United States Patent [19]

Hasebe et al.

[11] 4,175,376

[45] Nov. 27, 1979

[54] DEVICE FOR CORRECTING TIME INDICATION AND THE LIKE IN AN ELECTRONIC CLOCK

[75] Inventors: Sukehiro Hasebe; Masanao Oyamada, both of Tokyo, Japan

[73] Assignee: Copal Company Limited, Tokyo, Japan

[21] Appl. No.: 830,144

[22] Filed: Sep. 2, 1977

[30] Foreign Application Priority Data

Sep. 10, 1976 [JP] Japan ..... 51-108635

[51] Int. Cl.[2] ..... G04C 3/00; G04B 27/08

[52] U.S. Cl. ..... 58/23 R; 58/85.5

[58] Field of Search ..... 58/23 R, 23 AC, 34, 58/85.5, 35 R

[56] References Cited

U.S. PATENT DOCUMENTS

| | | | |
|---|---|---|---|
| 3,668,859 | 6/1972 | Polin et al. | 58/85.5 |
| 3,733,803 | 5/1973 | Hiraga et al. | 58/23 R |
| 3,931,703 | 1/1976 | Scherer et al. | 58/85.5 |
| 4,075,827 | 2/1978 | Yoshida et al. | 58/23 AC |

*Primary Examiner*—Vit W. Miska

*Attorney, Agent, or Firm*—Olbon, Fisher, Spivak, McClelland & Maier

[57] ABSTRACT

An electronic clock having a clock circuit in which reference clock pulses are frequency divided so as to be applied to a time indicating device for stepwise switching the time indication therein one by one unit of time for indicating the time, and the time indication is corrected stepwise one by one unit of time in timed relationship to the reference clock pulses by applying time correction pulses to the clock circuit until the correction of time is achieved. The device for correcting the time indication comprises a time correction signal generating circuit capable of applying time correction pulses of variable frequency to the clock circuit in timed relationship to the reference clock pulses so that the speed of the stepwise correction of time can be arbitrarily adjusted. The clock has a timer and the device for correcting the indication of time of the electronic clock can be used for correcting the time of the timer at which the timer is actuated, by switching the indication of time in the indicating device by the action of the switch means together with the readjustment of the set timer time in the clock circuit.

7 Claims, 7 Drawing Figures

DEVICE FOR CORRECTING TIME INDICATION AND THE LIKE IN AN ELECTRONIC CLOCK

BACKGROUND OF THE INVENTION

The present invention relates to a device for correcting indication of the time in an electronic clock or indication of the time at which a timer provided in such an electronic clock is actuated.

Heretofore, a device for correcting the time indication in an electronic clock or the time indication of a timer provided in an electronic clock has been proposed in which an electric circuit is provided by which the indication of time is stepwise advanced by one unit of time each time a correctig pulse is applied thereto, and a correcting pulse is generated each time a manually manipulatable member is actuated so that the correction of the time indication is achieved by actuating the manually manipulatable member so many times as required for the desired correction of the time indication thereby rendering the speed of correction of the time to be determined by the speed of the manual operation of the manipulatable member. Alternatively, lower frequency correction pulses or higher frequency correction pulses are electrically applied to the clock circuit of the electric clock so as to achieve the correction of the time indication at the predetermined higher or lower speed. In the former case of correction of the time indication, however, it is required to actuate the manipulatable member repeatedly so many times as required for the correction of the time indication thereby necessitating troublesome manual operation, while, in the latter case, the speed of correction of the time indication can not be adjusted arbitrarily so that the operation is rendered to be inconvenient.

The present invention aims at avoiding the above described disadvantages of the prior art electric clock.

SUMMARY OF THE INVENTION

An object of the present invention is to provide a novel and useful device for correcting the indication of time in an electronic clock which avoids the disadvantages of the prior art electronic clock by permitting the correction of the time indication to be carried out at any desired speed.

Another object of the present invention is to provide a novel and useful device for correcting the indication of time at which a timer provided in an electronic clock is actuated together with the readjustment of the set timer time which avoids the disadvantages of the prior art electronic clock having a timer by permitting the correction of the time indication to be carried out at any desired speed.

A further object of the present invention is to provide a novel and useful device for correcting the indication of time of an electronic clock or the indication of time of a timer provided in an electronic clock at which the timer is actuated, which permits the correction of the time in either of the advancing sense or the retarding sense at any desired speed by switching a switch provided in the electronic clock.

The present invention greatly facilitates the manipulation of the electronic clock in correcting the indication of time of the clock or the indication of the time at which the timer is actuated.

DETAILED DESCRIPTION OF THE PREFERRED EMBODIMENTS

Figure 1:
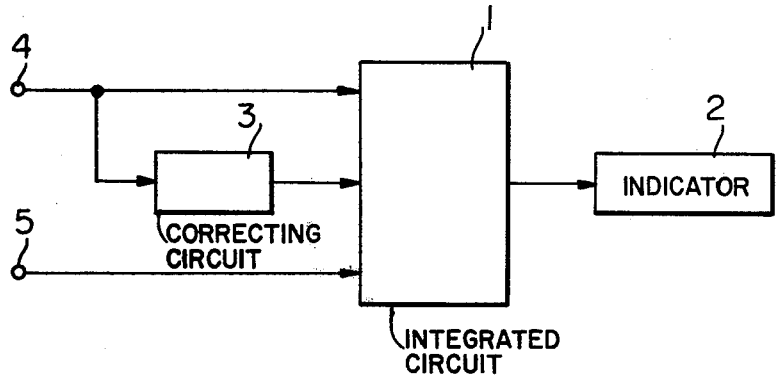
FIG. 1 is a block diagram showing an embodiment of the time correcting device of the present invention.

The embodiment shown in FIG. 1 incorporates therein an integrated circuit 1 for an electronic clock in which a frequency divider of the reference clock pulses, a clock circuit, a driving circuit of the time indicating device and a timer circuit are integrally formed.

Reference clock pulses are applied to input terminal 4 of the integrated circuit 1, while a time indication switching signal is applied to input terminal 5 of the integrated circuit 1 so that the output of the integrated circuit 1 is switched so as to selectively issue time indicating signal or timer actuation time indicating signal depending upon the switching of the time indication switching signal applied to the input 5. The output of the integrated circuit 1 is connected to a time indicating device 2 consisting of light emitting diodes, liquid crystal, fluorescent discharge tubes, gas discharge tubes or the like, so that, as the respective pulse of the reference clock pulses which are frequency divided in the integrated circuit 1 is applied successively to the time indicating device 2, the indication of time therein is changed one by one unit of time so as to indicate the time.

A time indication correcting signal generating circuit 3 is connected with its input to the reference clock pulses while the output thereof is connected through a normally opened switch to the integrated circuit 1 so that when the switch is closed, the integrated circuit 1 applies time indication correcting pulses to the time indicating device 2 in timed relationship to the reference clock pulses, thereby permitting the indication of time to be corrected one by one unit of time each time a pulse is applied.

In accordance with the characteristic feature of the present invention, the frequency of the time indication correcting output pulses of the correcting signal generating circuit 3 can be arbitrarily adjusted by a manually manipulatable member (not shown) in timed relationship to the reference clock pulses, so that the speed of correction of the time indication in the time indicating device 2 can be adjusted.

Figure 2:
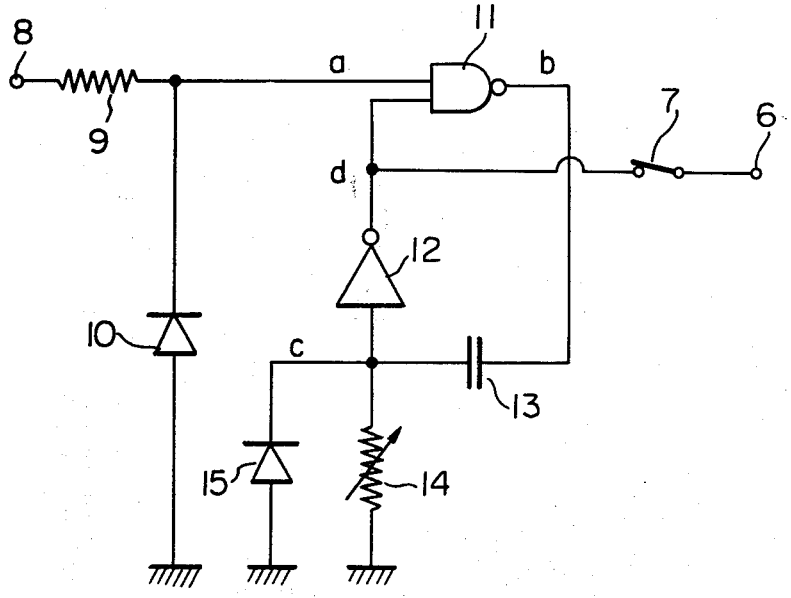
FIG. 2 is a wiring diagram showing the electric circuit of the time correction signal generating circuit of FIG. 1.

FIG. 2 shows an example of the electric circuit of the time correcting signal generating device 3. The circuit comprises a reference clock pulse input terminal 8 connected through an input resistor 9 to one of the inputs of a NAND circuit 11, another input of which is connected to one end of a variable resistor 14 through ain invertor 12, the other end of the variable resistor 14 being connected to the earth. The variable resistor 14 is manually adjustable by a manipulatable member (not shown) so as to vary the resistance value thereof. A capacitor 13 is connected between the output of the NAND circuit 11 and the junction c between the invertor 12 and the variable resistor 14, and the junction d between the other input of the NAND circuit 11 and the invertor 12 is connected to the output terminal 6 through a normally opened switch 7 so that time correction output pulses are applied to the integrated circuit 1 when the switch 7 is closed.

The circuit includes a diode 10 connected between the input terminal 8 and the earth so as to rectify the input pulses when AC pulses are applied. The NAND circuit 11 and the invertor 12 are connected to bias lines including diodes (not shown) for protecting the same. A diode 15 is connected in parallel to the variable resistor 14 for instantaneously discharging the electric charge stored in the capacitor 13. The frequency of the correcting pulses is determined by the capacitor 13 and the variable resistor 14 as described later.

As described previously, either one of the indication of the time of the electronic clock and the indication of the time at which the timer actuated can be corrected by the switching signal applied to the input 5 in FIG. 1, but the function of the correction of the time indication is quite the same in either of the cases.

Therefore, the description of the operation of the correcting signal generating circuit will be described taking the correction of the indication of the time of the clock as the example.

As described previously, the input 4 receives reference clock pulses, and the pulses are frequency divided in the integrated circuit 1 and applied to the time indicating device 2 for actuating the driving circuit of the time indicating device 2 to indicate the time.

When the correction of the time indication is to be effected, correction pulses of the variable frequency but occurring in timed relationship to the frequency of the reference clock pulses are applied from the correcting signal generating circuit 3 to the integrated circuit 1 so that the indication of the time in the indicating device 2 is stepwise advanced one by one unit of time for the respective time correction pulse applied to the integrated circuit 1.

Figure 3:
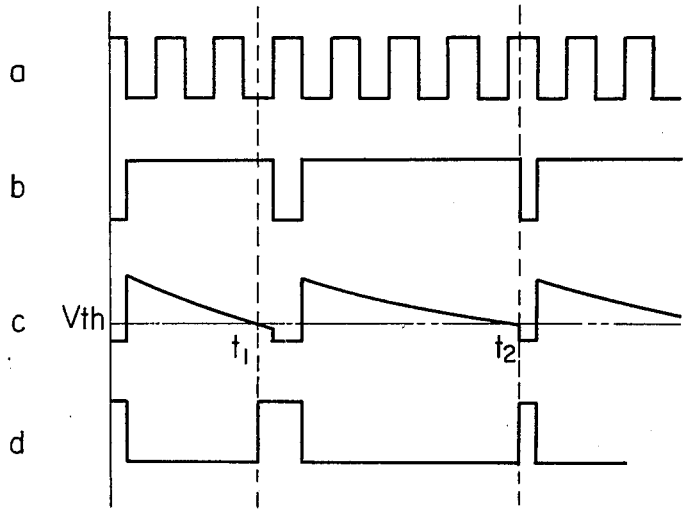
FIG. 3 is a diagram showing the time chart by which voltage variations with respect to lapse of time in various portions in the circuit of FIG. 2 are illustrated.

Referring now to FIGS. 2 and 3, the voltage at c (FIG. 3) is held at a low potential, i.e., the earth potential in the initial condition, so that the voltage at d is made high level as inverted by the invertor 12, while the reference clock pulses (50 Hz, for example) applied to the input 8 are made rectangular wave forms by the diode 10 as shown at a in FIG. 3, which are applied to the one input of the NAND circuit 11 as the plus rectangular wave forms. Thus, the output b of the NAND circuit 11 is made first low level as shown at b in FIG. 3, because the input a thereof generates inverted output and, when the input a is made low level, the output b is made high level so as to be applied to the capacitor 13 to render the voltage at c to be high (c in FIG. 3) to generate low level output d of the inverter 12, which low output d is applied to the input of the NAND circuit 11 so as to maintain high level output b of the NAND circuit 11 regardless of the input a as shown at b in FIG. 3, while the electric charge stored in the capacitor 13 is discharged through the variable resistor 14 to lower the voltage at c at a rate determined by the capacity of the capacitor 13 and the resistance value of the variable resistor 14 as adjusted as shown in FIG. 3 at C.

When the voltage at c reaches the threshold voltage $V_{th}$ of the invertor 12 at the time $t_1$, the output d of the invertor 12 is inverted to the high level so that the NAND circuit 11 is rendered to generate inverted output b to the input a. Therefore, when the input a is low level at the time $t_1$ as shown in FIG. 3, the output b is kept high level, while the voltage c is being further lowered by the discharge of the capacitor 13 through the variable resistor 14. However, when a high level input a appears at the input of the NAND circuit 11, the output b thereof is rendered to be low level as shown at b in FIG. 3, and, at the same time, the charge in the capacitor 13 is instantaneously discharged through the diode 15 to render the voltage at c to be the earth voltage. This condition continues insofar as high level input a is being applied to the input of the NAND circuit 11 (FIG. 3).

When the input voltage at a to the NAND circuit 11 is again rendered to be low level, the above described sequence of operations is repeated.

Therefore, the charging and discharging of the capacitor 13 and the generation of high level voltage at d as well as the generation of low level voltage at b are repeatedly effected in accordance with the frequency as determined by the capacity of the capacitor 13 and the resistance value of the variable resistor 14 as adjusted manually.

In FIG. 3, the output b of the NAND circuit 11 is rendered to be low level at the time of $t_2$ simultaneously with the inversion of the output d of the invertor 12 to the high level, because the input a is already rendered to be high level at the time the voltage c of the capacitor 13 reaches the threshold voltage $V_{th}$ of the invertor 12 at the time $t_2$ to invert the output thereof.

The signal d is applied through the switch 7 to the output terminal 6 which is connected to the integrated circuit 1 so as to carry out the correction of the time insofar as the switch 7 is closed.

In case the indication of the time at which the timer is to be actuated is corrected, the switching signal at the input 5 (FIG. 1) is switched so that the correction of the indication of the time as well as the setting of the time in the timer is adjusted by the actuation of the correction signal generating circuit 3 in the manner described above.

As is clear from FIG. 3, the output pulses b of the NAND circuit 11 per se can be used in correcting the time indication in place of using the output pulses d of the invertor 12 by appropriately modifying the circuit.

Also, the diode 15 may be dispensed with, because the protection diode for the invertor 12 is provided in the bias line which can be for discharging the capacitor 13.

Figure 4:
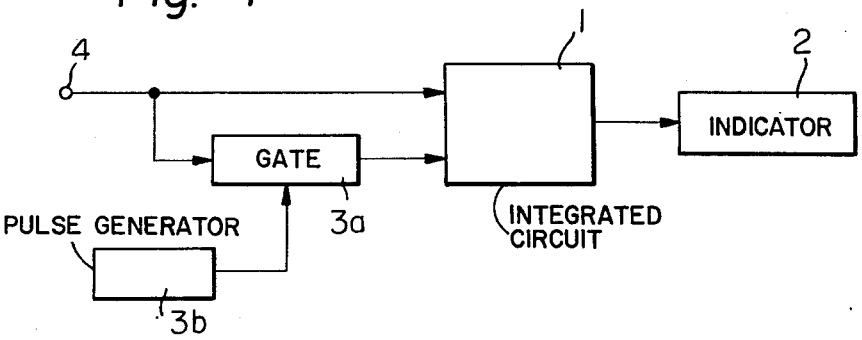
FIG. 4 is a block diagram showing another embodiment of the present invention.

FIG. 4 shows another embodiment of the present invention. The general construction of the circuit is similar to that shown in FIGS. 1 and 2.

In this embodiment a gate circuit **3*a* is connected between the input 4 and the integrated circuit 1 and a variable frequency pulse generating vibrator 3*b* is connected to the gate circuit 3*a*. The frequency of the vibrator 3*b*** can be arbitrarily adjusted manually by a manipulating member (not shown).

Thus, the reference clock pulses from the input 4 for use in correcting the time indication are allowed to be applied to the integrated circuit only when the gate circuit **3*a*** is opened by the pulses applied from the vibrator 3*b* so that the correction of the time indication is achieved in the manner as described previously.

Figure 5:
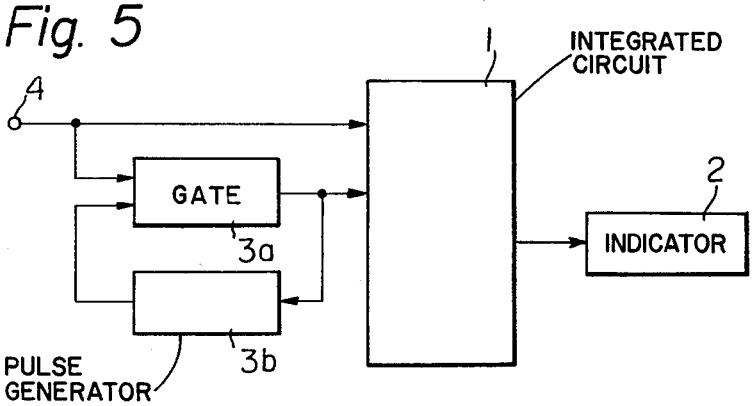
FIG. 5 is a block diagram showing a further embodiment of the present invention.

FIG. 5 shows a further embodiment of the present invention substantially similar to that of FIG. 4. In this embodiment, the output of the gate circuit 3*a* is fed back to the vibrator 3*b*. By this arrangement, a single correcting pulse is applied to the integrating circuit 1 each time the pulse is issued from the vibrator 3*b*.

In the present invention, time indication correcting pulses may be generated separately for the correction of the indication of the time of the clock and for the correction of the indication of the set timer time by separately constructed correcting signal generating circuits. Also, the present invention may be used in an electronic clock having no timer mechanism.

Figure 6:
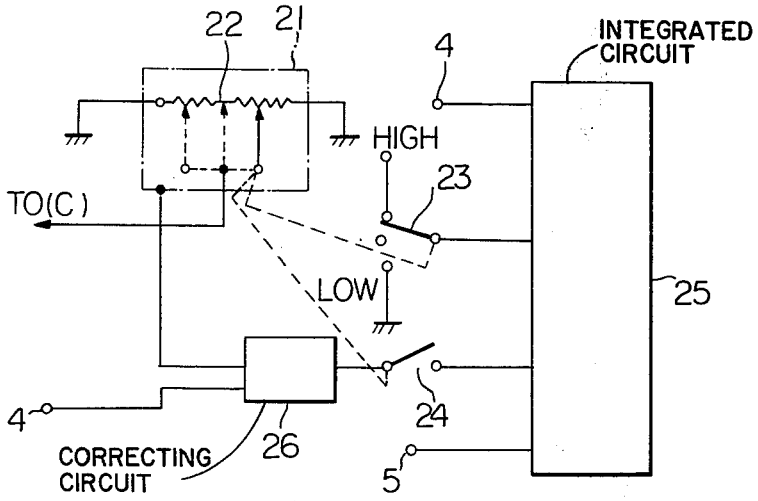
FIG. 6 is a block diagram showing a still further embodiment of the present invention.

FIG. 6 shows a still further embodiment of the present invention. In this embodiment, the correction of the indication of time can be effected in either of the advancing sense or the retarding sense by the provision of a switch 23 for switching the actuation of an adder in the integrated circuit 25 (similar to the integrated circuit 1 of FIG. 1) for the advancing mode of the time correction or for switching a substractor in the retarding mode of the time correction at a desired speed of correction of the time indication.

In FIG. 6, the variable resistor 21 (smilar to the variable resistor 14 in FIG. 1) can be adjusted by moving the movable contact thereof in either of the opposite two directions from the neutral point 22 so as to lower the resistance value thereof. The resistor 21 is connected to the correcting signal generating circuit 26 (similar to the correcting signal generating circuit 3 in FIG. 1), and the movable contact of the variable resistor 21 is operatively coupled with the switch 23 as well as with the switch 24 (similar to the switch 7 in FIG. 2). When the variable resistor 21 is adjusted to the neutral point 22, the switches 23, 24 are opened so as to render the time indication correction to be inoperative. But, when the variable resistor 21 is adjusted to either of the opposite two directions, the switch 23 is switched to the advancing mode of correction or to the retarding mode of correction depending upon the actuation of the variable resistor 21, while the switch 24 is closed for permitting the time indication correction to be carried out. The operation of the correction of the time indication is effected in the manner as described above at a desired speed by the amount of the adjustment of the variable resistor 21.

Figure 7:
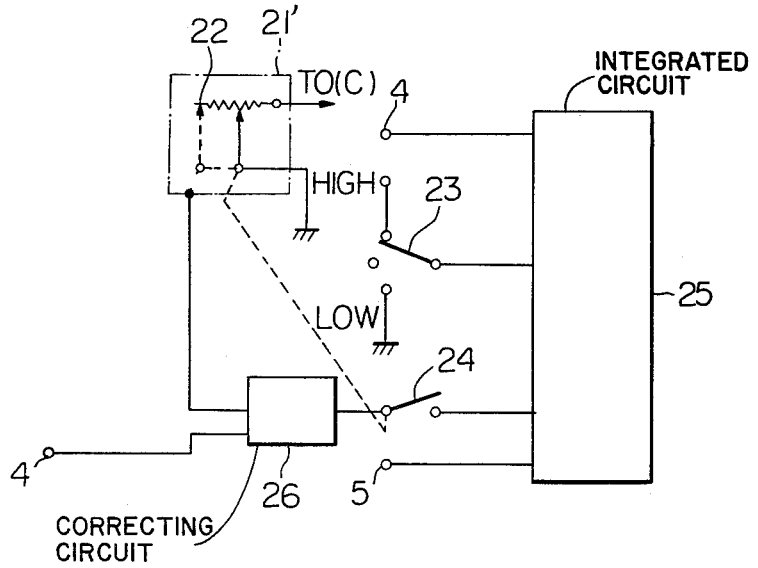
FIG. 7 is a block diagram showing a modification of the embodiment shown in FIG. 6.

FIG. 7 shows a modification of the embodiment of FIG. 6.

The variable resistor 21′ is constructed for solely varying the resistance value in one direction from the neutral point 22 and it is operatively connected to the switch 24 so that the switch 24 is closed when the variable resistor 21′ is adjusted moving apart from the neutral point 22 so as to permit the connecting operation to be effected, while the switch 24 is opened when the variable resistor 21′ is returned to the neutral position 22.

Thus, when the variable resistor 21′ is adjusted for the correcting operation at a desired speed to close the switch 24, the advancing or retarding mode of the time indication correction can be achieved by switching the switch 23 to the desired position.

We claim:

1. Device for correcting time indication in an electronic clock having a clock circuit in which reference clock pulses are frequency divided so as to be applied to a time indicating device for stepwise switching the time indication therein one by one unit of time for indicating the time, and the time indication is corrected stepwise one by one unit of time in timed relationship to said reference clock pulses by applying time correction pulses to said clock circuit until the correction of time is achieved, wherein the improvement comprises a gate circuit for opening and closing the application of said reference clock pulses to said clock circuit and a control circuit for applying pulses of variable frequency to said gate circuit so as to control the same to be opened and closed, said reference clock pulses being applied through said gate circuit to said clock circuit during the time said gate circuit is opened thereby permitting the speed of stepwise correction of time to be adjusted arbitrarily in timed relationship to said reference clock pulses.

2. Device according to claim 1, wherein said clock has a timer mechanism and a switching means for switching the indication of said time indicating device so as to indicate the time at which said timer is actuated by the setting of the timer actuating time in said clock circuit, said reference clock pulses being applied through said gate circuit to said clock circuit during the time said gate circuit is opened thereby permitting the speed of correction of the indication of time at which said timer is actuated to be arbitrarily adjusted in timed relationship to said reference clock pulses by the switching of said switching means together with the readjustment of the set timer time in said clock circuit.

3. Device according to claim 1, further comprising an adding counter circuit and a subtracting counter circuit and a switch for alternately connecting either one of said adding and subtracting counter circuits to said clock circuit by the switching of said switch, thereby permitting the indication of time to be corrected in the advancing sense or in the retarding sense by the actuation of said switch.

4. Device according to claim 1, further comprising an adding counter circuit and a subtracting counter circuit and a switch for alternately connecting either one of said adding and subtracting counter circuits to said clock circuit by the switching of said switch, thereby permitting the indication of the time at which said timer is actuated to be corrected in the advancing sense and in the retarding sense by the actuation of said switch.

5. Device according to claim 1, wherein said clock has a timer mechanism and a switching means for switching the indication of said time indicating device so as to indicate the time at which said timer is actuated by the setting of the timer actuating time in said clock circuit, said time correction signal generating circuit being adapted to apply said time correction pulses to said clock circuit so as to correct the indication of time at which said timer is actuated at an arbitrarily adjustable speed in timed relationship to said reference clock pulses by the switching of said switching means together with the readjustment of the set timer time in said clock circuit.

6. Device for correcting time indication in an electronic clock having a clock circuit in which reference clock pulses are frequency divided so as to be applied to a time indicating device for stepwise switching the time indication therein one by one unit of time for indicating the time, and the time indication is corrected stepwise one by one unit of time in timed relationship to said reference clock pulses by applying time correction pulses to said clock circuit until the correction of time is achieved, wherein the improvement comprises a gate circuit for opening and closing the application of said reference clock pulses to said clock circuit and a control circuit to which the output of said gate circuit is fed back and which applies pulses of variable frequency to said gate circuit so as to control the same to be opened and closed, and a manipulating member for adjusting arbitarily the frequency of said pulses generated by said control circuit, thereby permitting said reference clock pulses to be applied through said gate circuit to said clock circuit during the time said gate circuit is opened so as to permit the speed of stepwise correction of time to be adjusted arbitrarily in accordance with the frequency of said pulses generated by said control circuit.

7. Device according to claim 5, wherein said clock has a timer mechanism and a switching means for switching the indication of said time indicating device so as to indicate the time at which said timer is actuated by the setting of the timer actuating time in said clock circuit, said reference clock pulses being applied through said gate circuit to said clock circuit during the time said gate circuit is opened thereby permitting the speed of correction of the indication of time at which said timer is actuated to be arbitrarily adjusted by the adjustment of said manipulating member by the switching of said switching means together with the readjustment of the set timer time in said clock circuit.

* * * * *